US010975332B2

(12) United States Patent
Leon Navarro

(10) Patent No.: US 10,975,332 B2
(45) Date of Patent: Apr. 13, 2021

(54) HOME CARE COMPOSITIONS

(71) Applicant: COLGATE-PALMOLIVE COMPANY, New York, NY (US)

(72) Inventor: Juan Leon Navarro, Mexico D.F. Col Irrigacion (MX)

(73) Assignee: Colgate-Palmolive Company, New York, NY (US)

( * ) Notice: Subject to any disclaimer, the term of this patent is extended or adjusted under 35 U.S.C. 154(b) by 18 days.

(21) Appl. No.: 16/233,489

(22) Filed: Dec. 27, 2018

(65) Prior Publication Data

US 2020/0208080 A1 Jul. 2, 2020

(51) Int. Cl.

| | |
|---|---|
| ***C11D 1/94*** | (2006.01) |
| ***C11D 1/74*** | (2006.01) |
| ***C11D 11/00*** | (2006.01) |
| *C11D 1/29* | (2006.01) |
| *C11D 1/88* | (2006.01) |

(52) U.S. Cl.

CPC ..... *C11D 1/94* (2013.01); *C11D 1/74* (2013.01); *C11D 11/0023* (2013.01); *C11D 1/29* (2013.01); *C11D 1/88* (2013.01)

(58) Field of Classification Search

CPC ..... C11D 1/94; C11D 1/74; C11D 11/0023
See application file for complete search history.

(56) References Cited

U.S. PATENT DOCUMENTS

| | | | | |
|---|---|---|---|---|
| 5,637,758 | A * | 6/1997 | Sajic | C11D 1/28 560/147 |
| 5,998,347 | A | 12/1999 | D'Ambrogio et al. | |
| 5,998,355 | A * | 12/1999 | Brumbaugh | C11D 3/2093 510/424 |
| 8,247,362 | B2 | 8/2012 | Murphy et al. | |
| 8,623,806 | B2 * | 1/2014 | Scialla | C11D 3/3723 510/237 |
| 2018/0071198 | A1 * | 3/2018 | Lin | A61K 8/85 |
| 2018/0133133 | A1 | 5/2018 | Kleinen et al. | |
| 2018/0371364 | A1 * | 12/2018 | Rosmaninho | C11D 3/30 |
| 2019/0177658 | A1 * | 6/2019 | Hodge | C11D 1/94 |
| 2019/0224107 | A1 * | 7/2019 | Lin | A61K 8/39 |

FOREIGN PATENT DOCUMENTS

| | | | |
|---|---|---|---|
| EP | 0874041 | | 10/1998 |
| EP | 3418358 | | 12/2018 |
| JP | 2002-060783 | | 2/2002 |
| JP | 2002060783 | A * | 2/2002 |
| JP | 2005220112 | A * | 8/2005 |
| JP | 2006-117832 | | 5/2006 |
| JP | 2006117832 | A * | 5/2006 |
| WO | 1997/018284 | | 5/1997 |
| WO | WO 2008/074667 | A1 | 6/2008 |
| WO | 2017/058934 | | 4/2017 |

OTHER PUBLICATIONS

English Translation of JP 2005 220112 A (Year: 2005).*

International Search Report and Written Opinion of the International Searching Authority in International Application No. PCT/US2018/067616, dated Sep. 3, 2019.

Kinbarra et al., 2006, "Cleaning composition for cleaning of cooking appliances, contains preset amount of specific triglycerol fatty acid monoester and sucrose fatty acid monoester," WPI Database AN: 2006-325054, JP 2006-117832A.

Sashita et al., 2002, "Detergent composition, used in e.g. cleaning foods, tableware and body, contains polyglycerol fatty acid esters based on monoesters," WPI Database AN: 2002-346526, JP 2002-060783A.

* cited by examiner

*Primary Examiner* — Nicole M. Buie-Hatcher
*Assistant Examiner* — M. Reza Asdjodi

(57) ABSTRACT

Described herein are home care compositions comprising: a surfactant system comprising a non-ionic surfactant; and a carrier.

15 Claims, No Drawings

HOME CARE COMPOSITIONS

BACKGROUND

The development of home care composition (including, without limitation, dish soap) has long been driven by the challenge of providing a combination of performance properties such as good foaming, good cleansing, improved skin feel, and attractive product appearance. Specifically, while a certain component within a home care composition may enhance one property, it will often do so at the detriment of another important property of the home care composition.

For example, a home care composition may enhance cleansing by incorporating foaming agents at the expense of stability at various temperatures. Therefore, the need exists for a home care composition that provides the desired performance properties without sacrificing stability in cold weather conditions—specifically near freezing temperatures.

BRIEF SUMMARY

The present invention is directed to a home care composition comprising: a surfactant system comprising a nonionic surfactant; and a carrier.

In other embodiments, the present invention is directed to a method of cleaning dishware comprising: applying the home care composition according to any foregoing claim to a dish or utensil; applying water in an amount effective to create dish cleaning effective amount of foam to the dish or utensil; and rinsing the dish or utensil.

Other embodiments of the present invention include a cleaning composition comprising: water; and a first surfactant comprising polyglyceryl-3 laurate; wherein the cleaning composition is a dish soap.

Other embodiments of the present invention include a cleaning composition comprising water; a surfactant blend comprising: a first surfactant comprising polyglyceryl-3 laurate; a second surfactant comprising a zwitterionic compound; a third surfactant comprising an anionic compound.

Other embodiments of the present invention include a method of forming a dish soap, the method comprising: a) mixing together water and a first surfactant comprising polyglyceryl-3 laurate to form an aqueous blend; whereby the aqueous blend is a dish soap.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

The present invention is directed to a home care composition that is stable at cold temperatures. According to the present invention, the term "stable" refers to a composition's ability to withstand substantial changes in viscosity and/or changes in homogeneity. According to the present invention, the term "cold temperatures" refers to temperatures approaching and including the freezing temperature of water—i.e., temperatures that are ranging from about 5° C. to about −15° C.

As discussed in greater detail herein, the stability of the home care composition may allow the home care composition to be a homogenous liquid (i.e., the full volume having a substantially constant viscosity) at room temperature as well as temperatures as low as −10° C., thereby avoiding the formation of higher viscosity pockets—i.e., "gelled pockets."

The present invention is also directed to a home care composition that provides the requisite foaming characteristics needed for a cleaning composition. This includes not only initial foaming, but also maximum foaming and foaming removal.

The home care composition may comprise a liquid carrier and a surfactant composition. The liquid carrier may be present in an amount ranging from about 25 wt. % to about 90 wt. %-including all percentages and sub-ranges there-between. In a preferred embodiment, the liquid carrier may be present in an amount ranging from about 35 wt. % to about 85 wt. %-including all percentages and sub-ranges there-between. In some embodiments, the liquid carrier may be present in an amount ranging from about 45 wt. % to about 65 wt. %-including all percentages and sub-ranges there-between.

The liquid carrier may be water. The water may be soft water. The term "soft water" refers to water having a low concentration of ions, specifically, calcium and magnesium ions. For example, soft water is water having less than about 60 mg/l calcium carbonate, preferably less than 50 mg/l of calcium carbonate. The carrier may comprise 100 wt. % of water—specifically soft water.

In other embodiments, the carrier may be one or more solvents. In some embodiments, the liquid carrier may be an aqueous solvent. The liquid carrier may be predominantly water—i.e., greater than 50 wt. % water, based on the total weight of the carrier, with the remaining amounts being one or more suitable non-aqueous solvents. The carrier may be present in an amount ranging from 70.0 wt. % to about 99.0 wt. %—including all amounts and sub-ranges there-between—based on the total weight of the home care composition.

Typical solvents used in the cleaning composition are aqueous soluble, miscible or immiscible. Solvents can include aliphatic and aromatic hydrocarbons, chlorinated hydrocarbons, alcohols, ether compounds, fluorocarbon compounds, and other similar low molecular weight generally volatile liquid materials. Of these, preferred are alkanols; more preferred are ethanol, isopropanol, and propanol; and most preferred is ethanol. In a particularly desirable embodiment, the solvents of the cleaning composition are of alkanols, and more preferably the solvent is ethanol. In various embodiments, the compositions may include solvents in amounts of up to about 6 wt. %, preferably at least about wt. 0.1% by weight of the total composition.

In certain embodiments, water is not a solvent but when used acts as a diluent or as a dispersing medium for the active materials. In other embodiments, water is a solvent.

These materials can be used in solution or as a miscible mixture or as a dispersion of the solvent in the aqueous liquid. A solvent or cosolvent can be used to enhance certain soil removal properties of this invention. Cosolvents include alcohols and the mono and di-alkyl ethers of alkylene glycols, dialkylene glycols, trialkylene glycols, etc. Alcohols which are useful as cosolvents in this invention include methanol, ethanol, propanol and isopropanol. Other suitable solvents include the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme. Nonaqueous liquid solvents can be used for varying compositions of the present invention. These include the higher glycols, polyglycols, polyoxides and glycol ethers.

Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), propylene glycol n-butyl ether, dipropylene glycol monobutyl ether, ethylene glycol n-butyl ether and ethylene glycol n-propyl ether, and combinations thereof. In certain embodiments, the glycol solvent is propylene glycol n-butyl ether. In certain embodiments, the glycol solvent is dipropylene glycol monobutyl ether.

Other useful solvents are ethylene oxide/propylene oxide, liquid random copolymer such as Synalox® solvent series from Dow Chemical (e.g., Synalox® 50-50B). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the trade name Dowanol®). Also tripropylene glycol mono methyl ether "Dowanol TPM®" from Dow Chemical is suitable.

The final ingredient in the inventive cleaning compositions is water. The proportion of water in the compositions generally is in the range of about 35% to about 90% or about 50% to 85% by weight of the cleaning composition.

The surfactant composition may be present in an amount ranging from about 30.0 wt. % to about 55.0 wt. % based on the total weight of the home care composition—including all percentages and sub-ranges there-between. In a preferred embodiment, the surfactant composition may be present in an amount ranging from about 35.0 wt. % to about 50.0 wt. % based on the total weight of the home care composition—including all percentages and sub-ranges there-between.

The surfactant composition may comprise a first surfactant that is an ester-containing compound that comprises a plurality of hydroxyl groups. The ester-containing compound may be derived from lauric acid and a hydroxyl-containing compound. The ester-containing compound may comprise 2-4 hydroxyl groups—preferably about 4 hydroxyl groups. The ester-containing compound may be polyglyceryl laurate. In a preferred embodiment, the polyglyceryl laurate is polyglyceryl-3 laurate.

The first surfactant may be present in an amount ranging from about 0.1 wt. % to about 2.0 wt. % based on the total weight of the home care composition—including all percentages and subranges there-between. In a preferred embodiment, the first surfactant is present in an amount ranging from about 0.5 wt. % to about 1.0 wt. % based on the total weight of the home care composition—including all percentages and sub-ranges there-between.

The surfactant composition may further comprise a second surfactant that is different from the first surfactant. The second surfactant may comprise a zwitterionic compound.

In certain embodiment, the zwitterionic surfactant is also an amphoteric surfactant. Amphoteric and zwitterionic surfactants are those compounds that have the capacity of behaving either as an acid or a base. Suitable zwitterionic or amphoteric surfactants include, but are not limited to, alkyl betaines, alkyl amidopropyl betaines, alkyl sulphobetaines, alkyl glycinates, alkyl carboxyglycinates, alkyl amphopropionates, alkyl amidopropyl hydroxysultaines, acyl taurates and acyl glutamates wherein the alkyl and acyl groups have about 8 to about 18 carbon atoms. Examples include cocamidopropyl betaine, sodium cocoamphoacetate, cocamidopropyl hydroxysultaine, lauryl betaine, myristyl betaine, laurylamidopropyl betaine, myristamidopropyl betaine, and sodium cocamphopropionate.

In another embodiment, suitable zwitterionic surfactants for use herein contain both a cationic hydrophilic group (i.e., a quaternary ammonium group) and anionic hydrophilic group on the same molecule at a relatively wide range of pHs. The typical anionic hydrophilic groups are carboxylates and sulfonates, although other groups like sulfates, phosphonates, and the like can be used.

In certain embodiments, the zwitterionic surfactants also include hydrophobic groups including aliphatic or aromatic, saturated or unsaturated, substituted or unsubstituted hydrocarbon chains that can contain linking groups such as amido groups, ester groups. In another embodiment the hydrophobic group is an alkyl group containing about 1 to about 24 carbon atoms, in another embodiment about 8 to about 18, and in another embodiment about 10 to about 16. In certain embodiments, simple alkyl groups are utilized for cost and stability reasons.

Some common examples of betaine/sulphobetaine are described in U.S. Pat. Nos. 2,082,275, 2,702,279 and 2,255,082.

Examples of suitable alkyldimethyl betaines include, but are not limited, cocodimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamido-propyl betaine or $C_{10}$-$C_{14}$ fatty acylamidopropylene(hydropropylene)-sulfobetaine. For example $C_{10}$-$C_{14}$ fatty acylamidopropylene(hydropropylene)-sulfobetaine is commercially available from Sherex Company under the trade name "Varion CAS® sulfobetaine." A further example of betaine is Lauryl-imino-dipropionate. Laurylamido propylbetaine is commercially available from Stepan Chemical under tradename AmphoSol LB.

In certain embodiments, the zwitterionic surfactant is present in an amount of about 2 wt. % to about 7 wt. % based on the weight of the total composition. In certain embodiments, the zwitterionic surfactant is present in an amount of about 2.5 wt. % to about 6.5 wt. % based on the weight of the total composition. In certain embodiments, the zwitterionic surfactant is present in an amount of about 5.5 wt. % to about 6.5 wt. % based on the weight of the total composition.

In a preferred embodiment, the second surfactant zwitterionic compound may be an amine oxide compound. The amine oxide compound is at least one of lauryl aminopropyl dimethyl amine oxide, myristyl amindopropyl dimethyl amine oxide, and mixtures thereof.

The second surfactant may be present in an amount ranging from about 3 wt. % to about 20.0 wt. % based on the total weight of the home care composition—including all percentages and sub-ranges there-between. In some embodiments, the second surfactant may be present in an amount ranging from about 3 wt. % to about 8 wt. %-based on the total weight of the home care composition—including all percentages and sub-ranges there-between. In other embodiments, the second surfactant may be present in an amount ranging from about 14 wt. % to about 19 wt. %—based on the total weight of the home care composition—including all percentages and sub-ranges there-between.

The surfactant composition may further comprise a third surfactant that is different from the first and/or second surfactant. The third surfactant may comprise an anionic compound.

The anionic surfactants, which may be used in the compositions of the invention include water soluble anionic sulfonate surfactants and include sodium salts of linear $C_8$-$C_{16}$ alkyl benzene sulfonates; $C_{10}$-$C_{20}$ paraffin sulfonates, alpha olefin sulfonates containing about 10 to about 24 carbon atoms and $C_8$-$C_{18}$ alkyl sulfates and mixtures thereof.

The anionic surfactant may be any of the anionic surfactants known or previously used in the art of aqueous surfactant compositions. Suitable anionic surfactants include, but are not limited to, alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. Preferred are sodium salts of the surfactants. The alkyl groups generally contain about 8 to about 18 carbon atoms and may be unsaturated.

In certain embodiments, suitable anionic surfactants include sodium lauryl ether sulfate, ammonium lauryl ether sulfate, sodium lauryl sulfate, ammonium lauryl sulfate, triethanolamine lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, sodium cocoyl sarcosinate, triethanolamine monolauryl phosphate, and fatty acid soaps. Preferred are sodium lauryl ether sulfate, sodium lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, and sodium cocoyl sarcosinate.

In certain illustrative embodiments, examples of suitable sulfonated anionic surfactants include, but are not limited to, alkyl mononuclear aromatic sulfonates, such as the higher alkylbenzene sulfonates containing in one embodiment 8 to 18 carbon atoms, in another embodiment 11 to 16 carbon atoms, and in another embodiment 14 or 15 carbon atoms, the higher alkyl group in a straight or branched chain, or C8-15 alkyl toluene sulfonates and $C_8$-$C_{15}$ alkyl phenol sulfonates. In another embodiment, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Illustrative materials are described in U.S. Pat. No. 3,320,174. Of these, preferred are sodium salts of the anionic surfactants.

In another embodiment, examples of suitable sulfonated anionic surfactants include, but are not limited to, those surface-active or detergent compounds, which contain an organic hydrophobic group containing generally about 8 to about 26 carbon atoms or 10 to 18 carbon atoms in their molecular structure and at least one water-solubilizing group including, but not limited to, sulfonate, sulfate and carboxylate so as to form a water-soluble detergent. Usually, the hydrophobic group will include a $C_8$-$C_{22}$ alkyl, alkyl or acyl group. Such surfactants are employed in the form of water-soluble salts and the salt-forming cation is sodium, potassium, ammonium, magnesium and mono-, di- or tri-$C_2$-$C_3$ alkanolammonium. In an illustrative embodiment the cations are sodium, magnesium or ammonium cations, and preferred is sodium.

Other suitable anionic surfactants encompassed within the scope of the invention include, but are not limited to, the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, or 12 to 21 carbon atoms and having the formula $RCH{=}CHR_1$ where R is a higher alkyl group of 6 to 23 carbons and R1 is an alkyl group of 1 to 17 carbons or hydrogen to form a mixture of sulfones and alkene sulfonic acids which is then treated to convert the sulfones to sulfonates. In other embodiments olefin sulfonates contain about 14 to about 16 carbon atoms in the R alkyl group and are obtained by sulfonating an alpha-olefin.

Other examples of suitable anionic sulfonate surfactants encompassed within the scope of the invention include the paraffin sulfonates containing about 10 to about 20, or about 13 to about 17 carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

The compositions of the invention may also include alkyl ethoxylated ether sulfates or alkyl ether sulfates. Another surfactant utilized in the instant composition at a concentration of about 2 to about 15% by weight in one embodiment or about 4 to about 14% by weight in another embodiment is a metal salt of a $C_8$-$C_{18}$ alkyl ether sulfate. The alkyl ether sulfate (AEOS.xEO) is depicted by the Formula I:

$$R^1\text{—}(OCH(CH_3)CH_2)xOSO_3M \qquad \text{Formula I}$$

In one embodiment, x is 1 to 22; in another embodiment x is 1 to 10. In certain embodiments, $R^1$ is an alkyl group having 10 to 16 carbon atoms; in other embodiments $R^1$ is an alkyl group having 12 to 15 carbon atoms. In other embodiments, $R^1$ is $C_{12}$-$C_{14}$, $C_{12}$-$C_{13}$ and $C_{12}$-$C_{15}$ and M is an alkali metal cation such as, for example, lithium, potassium, sodium or magnesium, preferably sodium.

Other examples of anionic ethoxylated sulfates are the $C_8$-$C_{18}$ alkyl ether sulfate salts having the Formula II:

$$R^1(OCH_2CH_2)nOSO_3M \qquad \text{Formula II}$$

wherein $R^1$ and M are defined above and n is 1 to 22, preferably 1 to 3.

In a preferred embodiment, the anionic compound may be an alkyl ether sulfate compound. The alkyl ether sulfate compound may be at least one of ammonium lauryl ether sulfate, alkali metal lauryl ether sulfate, and mixtures thereof. The alkyl ether sulfate compound has an ethoxylation ranging from about 0.5 to about 2.0—including all ethoxylation amount and sub-ranges there-between. In a preferred embodiment, the alkyl ether sulfate compound may have an ethoxylation of about 0.6.

The third surfactant may be present in an amount ranging from about 10 wt. % to about 30 wt. % based on the total weight of the home care composition—including all percentages and sub-ranges there-between. In some embodiments, the third surfactant may be present in an amount ranging from about 14 wt. % to about 17 wt. % based on the total weight of the cleaning composition—including all percentages and sub-ranges there-between. In other embodiments, the third surfactant may be present in an amount ranging from about 21 wt. % to about 28 wt. % based on the total weight of the cleaning composition—including all percentages and sub-ranges there-between.

In some embodiments, the surfactant composition may further comprise a non-ionic surfactant. The non-ionic surfactant may be present in minor amounts, up to 3 wt. %, of other surfactants including nonionic surfactants. Suitable nonionic surfactants include alcohol ethoxylates, such as, the primary aliphatic alcohol ethoxylates, secondary aliphatic alcohol ethoxylates, and alkylphenol ethoxylates, and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups According to the present invention, the first surfactant and the second surfactant may be present in a weight ratio ranging from about 1:4 to about 1:9—including all ratios and sub-ranges there-between. The first surfactant and the third surfactant may be present in a weight ratio of about 1:14 to about 1:33—including all ratios and sub-ranges there-between. The second surfactant and the third surfactant may be present in a weight ratio of about 1:1 to about 1:5—including all ratios and sub-ranges there-between.

The overall surfactant blend may be present in an amount ranging from about 10 wt. % to about 30 wt. % based on the total weight of the home care composition.

The home care composition may further comprise one or more additives to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the cleaning operation for which it is to be used.

Suitable additives include, but are not limited to, builders, chelating agents, dye transfer inhibiting agents, viscosity modifiers, dispersants, additional enzymes, and enzyme stabilizers, catalytic materials, bleaches, bleach activators, hydrogen peroxide, sources of hydrogen peroxide, preformed peracids, polymeric dispersing agents, threshold inhibitors for hard water precipitation pigments, clay soil removal/anti-redeposition agents, brighteners, suds suppressors, dyes, fabric hueing agents, perfumes, structure elasticizing agents, fabric softeners, carriers, hydrotropes, processing aids, solvents, pigments antimicrobials, pH buffers, processing aids, active fluorescent whitening ingredient, additional surfactants and mixtures thereof. In addition to the disclosure below, suitable examples of such other adjuncts and levels of use are found in U.S. Pat. Nos. 5,576,282, 6,306,812 B1 and 6,326,348 B1 that are incorporated by reference.

The home care composition according to the present invention may have a first viscosity ranging from about 100 cps to about 7,000 cps—including all viscosities and sub-ranges there-between—whereby the viscosity is measured at room temperature. The home care composition according to the present invention may also have a second viscosity ranging from about 1,000 to about 6,900—whereby the viscosity is measured at temperature ranging from about 0° C. to about −10° C. The first and second viscosities of the home care composition may be substantially equal.

The home care composition according to the present invention may have a pH ranging from about 7 to about 13—including all pH values and sub-ranges there-between.

The home care composition may further comprise one or more buffer and/or a pH-adjusting agent, including inorganic and/or organic alkalinity sources and acidifying agents such as water-soluble alkali metal, and/or alkali earth metal salts of hydroxides, oxides, carbonates, bicarbonates, borates, silicates, phosphates, and/or metasilicates; or sodium hydroxide, potassium hydroxide, pyrophosphate, orthophosphate, polyphosphate, and/or phosphonate or sodium bisulfate. The organic alkalinity source herein includes a primary, secondary, and/or tertiary amine.

According to the present invention, the acid constituent, which can be a water soluble organic acid. The organic acids of the invention generally include at least one carbon atom and include at least one carboxyl group (—COOH) in its structure. In certain embodiments, water soluble organic acids contain from 1 to about 6 carbon atoms and at least one carboxyl group.

The inorganic acidifying agent herein includes HF, HCl, HBr, HI, boric acid, sulfuric acid, phosphoric acid, and/or sulphonic acid; or boric acid. The organic acidifying agent herein includes substituted and substituted, branched, linear and/or cyclic $C_{1-30}$ carboxylic acid. Acidiying agent may comprise pentetic acid ("DTPA").

In certain embodiments, organic acids include, but are not limited to, formic acid, citric acid, sorbic acid, acetic acid, glycolic acid, propanoic acid, propionic acid, oxalic acid, maleic acid, tartaric acid, adipic acid, lactic acid, malic acid, malonic acid, glycolic acid, and mixtures thereof. A preferred acid is lactic acid, for example, D- and/or L-lactic acid or mixtures thereof, and more preferred is L-lactic acid.

The compositions are acidic in nature (pH<7.0). Accordingly, there should be sufficient acid present in the composition such that the pH of the composition in various embodiments is less than about 6, or about 2 to about 5, or about 3 to about 4, or about 3.1 to about 3.5, or about 3.2 to about 3.3. The pH of the composition incorporating a selected acid is preferred to be within 10% of the pKa of the selected acid. Mixtures of two or more acids may be used, and the acid constituent may be present in any effective amount. The pH of the composition after the aging period remains less than about 6.5, or about 2.1 to about 5, or about 3 to about 4, or about 3.2 to about 3.8. The pH of the composition after the aging period incorporating a selected acid is preferred to be within 10% of the pKa of the selected acid. The aging period should be at least about two months, or about 6 months, or about 1 year or about 2 years.

The acid is present in an amount of less than about of 5% wt. based on the total weight of the compositions. In other embodiments, the acid is present in an amount of about 0.05 to about 4% wt., from about 1 to about 3% wt., and in an amount of about 2% wt. to about 2.5% wt. The amount of acid present after the aging period should not differ substantially from the level of acid in the initial composition.

The cleaning composition of the present invention may further comprise one or more sequestering/chelating agents. In certain embodiments, the cleaning compositions of the invention can also contain an organic or inorganic sequestrant or mixtures of sequestrants. Organic sequestrants such as citric acid, the alkali metal salts of nitrilotriacetic acid (NTA), EDTA or salts thereof, alkali metal gluconates, polyelectrolytes such as a polyacrylic acid, and the like can be used herein. In certain embodiments, sequestrants are organic sequestrants such as sodium gluconate due to the compatibility of the sequestrant with the formulation base.

The sequestering agent of the invention also includes an effective amount of a water-soluble organic phosphonic acid, which has sequestering properties. In certain embodiments, phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like.

The phosphonic acid may also include a low molecular weight phosphonopolycarboxylic acid such as one having about 2-4 carboxylic acid moieties and about 1-3 phosphonic acid groups. Such acids include 1-phosphono-1-methylsuccinic acid, phosphonosuccinic acid and 2-phosphonobutane-1,2,4-tricarboxylic acid.

Other organic phosphonic acids include 1-hydroxyethylidene-1,1-diphosphonic acid ($CH_3C(PO_3H_2)_2OH$), available from Monsanto Industrial Chemicals Co., St. Louis, Mo. as Dequest® 2010, a 58-62% aqueous solution; amino [tri (methylenephosphonic acid)]($N[CH_2PO_3H_2]_3$), available from Monsanto as Dequest® 2000, a 50% aqueous solution; ethylenediamine [tetra(methylene-phosphonic acid)] available from Monsanto as Dequest® 2041, a 90% solid acid product; and 2-phosphonobutane-1,2,4-tricarboxylic acid available from Mobay Chemical Corporation, Inorganic Chemicals Division, Pittsburgh, Pa. as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein. In certain embodiments, phosphonic acids useful in the present invention do not contain amino groups since they produce substantially less degradation of the active chlorine source than do phosphonic acids including amino groups.

Sequestrants of the invention also include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

In certain embodiments, sodium tripolyphosphate is an inorganic hardness sequestering agent for reasons of its ease of availability, low cost, and high cleaning power. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt-%) and its concentration must be increased using means other than solubility. Typical examples of such phosphates being alkaline condensed phosphates (i.e. polyphosphates) such as sodium or potassium pyrophosphate, sodium or potassium tripolyphosphate, sodium or potassium hexametaphosphate; carbonates such as sodium or potassium carbonate; borates, such as sodium borate.

If utilized, the sequestering or chelating agent(s) will generally include about 0.00015% to about 15% by weight of the cleaning compositions herein. In other various embodiments, if utilized, the sequestering or chelating agent (s) will include about 0.0003% to about 3.0% by weight of such compositions or about 0.003% to about 1.0% by weight of such compositions or about 0.03% to about 0.1% by weight of such compositions.

The cleaning composition of the present invention may further comprise one or more fragrance agents (also referred to herein as a "fragrance"). Fragrance agents useful in the compositions and methods include a wide variety of natural and synthetic chemical ingredients, including, but not limited to, aldehydes, ketones, esters, and the like. Also included are various natural extracts and essences, which can include complex mixtures of ingredients, such as orange oil, lemon oil, rose extract, lavender, musk, patchouli, balsamic essence, sandalwood oil, pine oil, cedar, and the like. Finished fragrance agents can include extremely complex mixtures of such ingredients. Finished fragrance agents typically include about 0.01% to about 2%, by weight, of the detergent compositions herein, and individual fragrance agents can include about 0.0001% to about 90% of a finished perfume composition.

In a certain embodiments of the invention, the composition includes a blooming perfume. A blooming perfume ingredient is characterized by its boiling point (B.P.) and its octanol/water partition coefficient (P). The octanol/water partition coefficient of a perfume ingredient is the ratio between its equilibrium concentrations in octanol and in water. The fragrance agents of the invention have a B.P., determined at the normal, standard pressure of about 760 mm Hg, of about 260° C. or lower, less than about 255° C.; and less than about 250° C., and an octanol/water partition coefficient P of about 1,000 or higher. Since the partition coefficients of the fragrance agents of the invention have high values, they are more conveniently given in the form of their logarithm to the base 10, log P. Thus the fragrance agents have log P of about 3 or higher, or more than about 3.1, or more than about 3.2.

In certain embodiments, the compositions can include a combination of fragrance agents. In certain embodiments, the composition includes a first perfume ingredient having boiling point of 250° C. or less and C log P of 3.0 or less; and a second perfume ingredient having boiling point of 250° C. or less and C log P of 3.0 or more.

The cleaning composition of the present invention may further comprise one or more hydrotrope(s). Without being limited by theory it is believed that the hydrotrope contributes to the physical and chemical stability of the compositions.

Suitable hydrotropes include sulfonated hydrotropes. Any sulfonated hydrotropes known to those skilled in the art are suitable for use herein. In certain embodiments, alkyl aryl sulfonates or alkyl aryl sulfonic acids are used. In other embodiments alkyl aryl sulfonates include sodium, potassium, calcium and ammonium xylene sulfonates; sodium, potassium, calcium and ammonium toluene sulfonates; sodium, potassium, calcium and ammonium cumene sulfonates; sodium, potassium, calcium and ammonium substituted or unsubstituted naphthalene sulfonates and mixtures thereof, and preferred are sodium salts thereof. In other embodiments alkyl aryl sulfonic acids include xylenesulfonic acid, toluenesulfonic acid, cumenesulfonic acid, substituted or unsubstituted naphthalenesulfonic acid and salts thereof. In other embodiments, xylenesulfonic acid or p-toluene sulfonate or mixtures thereof are used.

In various embodiments, the compositions may include hydrotropes in amounts of about 0.01 wt. % to 20 wt. %, about wt. 0.05% to 10 wt. % or about 0.1 wt. % to 5 wt. % or about 3 wt. % by weight of the total composition.

The cleaning composition may comprise a thickening or structuring agent. Suitable thickening or structuring agents may be organic or inorganic in nature. The agent may thicken the composition by either thickening the aqueous portions of the composition, or by thickening the non-aqueous portions of the composition. In certain embodiments, the agent is a water soluble polymer. In other embodiments, the agent is a cationic water soluble polymer.

In certain embodiments, the polymeric thickener may be added to the composition to achieve two objectives (i) to increase the "flow" viscosity or the yield stress, and (ii) to neutralize the anionic detergent carry-over guaranteeing a high level of softness in washing conditions where the carry-over is high. The flow viscosity corresponds to the viscosity measured with a flowmeter. The flowability of the tested composition is expressed as time needed to a fixed amount of product flowing through a small tube.

Thickeners can be divided into organic and inorganic thickeners. Of the organic thickeners there are (1) cellulosic thickeners and their derivatives, (2) natural gums, (3) acrylates, (4) starches, (5) stearates, (6) fatty acid alcohols and inorganic thickeners including (7) clays, and (8) salts. Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, gellan gum, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, tromethamine magnesium aluminum silicate, and the like. Some non-limiting examples of salts include calcium chloride, sodium chloride, sodium sulfate, ammonium chloride, and the like.

Some non-limiting examples of thickeners that thicken the non-aqueous portions of the composition include waxes such as candelilla wax, carnauba wax, beeswax, and the like, oils, vegetable oils and animal oils, and the like.

The composition may contain one thickener or a mixture of two or more thickeners. In certain embodiments the thickeners do not adversely react with the other components or compounds of the invention or otherwise render the composition of the invention ineffective. It is understood that a person skilled in the art will know how to select an appropriate thickener and control any adverse reactions through formulating.

The amount of thickener present in the composition depends on the desired viscosity of the composition. The composition may have a viscosity of about 100 to about 15,000 centipoise, of about 150 to about 10,000 centipoise, and of about 200 to about 5,000 centipoise as determined using a Brookfield DV-II+rotational viscometer using spindle #21 @ 20 rpm @ 70° F. Accordingly, to achieve the desired viscosities, the thickener may be present in the composition in an amount about 0.001 wt. % to about 5 wt. % of the total composition, about 0.01 wt. % to about 3 wt. %, and about 0.05 wt. % to about 2 wt. % of the total composition.

Thickeners from said classes of substance are commercially broadly available and are obtainable, for example, under the trade names Acusol® 820 (methacrylic acid (stearyl alcohol-20 EO) ester-acrylic acid copolymer, 30% strength in water, Rohm & Haas), Dapral®-GT-282-S (alkyl polyglycol ether, Akzo), Deuterol® polymer-11 (dicarboxylic acid copolymer, Schoner GmbH), Deuteron® XG (anionic heteropolysaccharide based on beta-D-glucose, D-manose, D-glucuronic acid, Schoner GmbH), Deuteron®-XN (nonionogenic polysaccharide, Schoner GmbH), Dicrylan® thickener-O (ethylene oxide adduct, 50% strength in water/isopropanol, Pfersse Chemie), EMA®-81 and EMA®-91 (ethylene-maleic anhydride copolymer, Monsanto), thickener-QR-100 (polyurethane emulsion, 19 21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell) and Shellflo®-XA (xanthan biopolymer, stabilized with formaldehyde, Shell).

The inventors have discovered that xanthan gum is useful as a thickening agent for suspending fragrance molecules in a hard surface cleaner. In certain embodiments, the thickening agent is xanthan gum. In other embodiments, the thickening agent is xanthan gum present in at least about 0.2 weight %.

Other non-limiting examples of additional optional components include, but are not limited to, hydrotropes, fluorescent whitening agents, photobleaches, fiber lubricants, reducing agents, enzymes, enzyme stabilizing agents, powder finishing agents, builders, bleaches, bleach catalysts, soil release agents, dye transfer inhibitors, buffers, colorants, fragrances, pro-fragrances, rheology modifiers, anti-ashing polymers, soil repellents, water-resistance agents, suspending agents, aesthetic agents, structuring agents, sanitizers, solvents, fabric finishing agents, dye fixatives, fabric conditioning agents and deodorizers.

In addition to the previously mentioned constituents of the composition, one may also employ normal and conventional adjuvants, provided they do not adversely affect the properties of the detergent. Thus there may be used a cationic antibacterial agent, coloring agents and perfumes; polyethylene glycol, ultraviolet light absorbers such as the Uvinuls, which are products of GAF Corporation; pH modifiers; etc. The proportion of such adjuvant materials, in total will normally not exceed 15% by weight of the detergent composition, and the percentages of illustrative examples of such individual components will be about 5% by weight. Sodium formate or formalin or Quatemium 15 (Dowicil 75) can be included in the formula as a preservative at a concentration of about 0.1 to about 4.0 wt. %.

The present invention further includes a method for forming the home care composition, the method comprising mixing together liquid carrier and the surfactant composition to form an aqueous blend. The liquid carrier and the surfactant composition may be agitated as to mix the various components, whereby the agitation is performed in a way as to not causing the blend to foam.

According to some embodiments, the home care composition may be a dish cleaning composition—also referred to as a dish soap. The term "dish soap" refers to a cleaning composition suitable for cleaning culinary hard surfaces, such as ceramic plates, glass cups, metal cookware, and other dishware as well as utensils.

The present invention further comprises a method of cleaning dishware comprising: applying the home care composition according to any foregoing claim to a dish or utensil and applying additional amounts of water in an amount effective to create dish cleaning effective amount of foam to the dish or utensil. The additional amounts of water and home care composition can be applied to the dishware simultaneously. In other embodiments, the home care composition may be applied to the dishware before the additional amounts of water. In other embodiments, additional amounts of water can be applied before, during and after application of the home care composition to the dishware.

Once the home care composition and additional amounts of water applied to the dishware, the dishware and/or utensils are rinsed, thereby cleaning them from uneaten foodstuffs and/or waste.

The invention will be described in greater detail by way of specific examples. The following examples are offered for illustrative purposes and are not intended to limit the invention in any manner.

EXAMPLES

Example 1

A first experiment was performed to measure the stability of the newly formulated cleaning composition comprising the surfactant blend of the present invention. Multiple formulations were prepared using the following components:

Water: softened water

Surfactant 1: polyglyceryl-3 laurate

Surfactant 2: blend of lauryl aminopropyl dimethyl amine oxide and myristyl amindopropyl dimethyl amine oxide Surfactant 3: anionic alkyl ether sulfate Preservative: blend of methylisothiazolinone ("MIT") and benzisothiazolinone ("BIT")

Cleaning salt 1: magnesium sulfate

DTPA: pentetic acid

Alcohol: blend of ethanol (95%) and methanol (5%)

The base formulation is set forth in Table 1—the amounts are set forth in weight (grams).

TABLE 1

| Component | Composition A (g) | Composition B (g) |
|---|---|---|
| Surfactant 1 | — | 1.7 |
| Surfactant 2 | 16.1 | 16.1 |
| Surfactant 3 | 21.7 | 21.7 |
| Preservative | 0.14 | 0.14 |
| Cleaning Salt 1 | 2.0 | 2.0 |
| DTPA | 0.31 | 0.31 |
| Fragrance | 0.5 | 0.5 |
| Alcohol | 0.4 | 0.4 |

Using the base formulations of Table 1, a number of sample cleaning compositions were prepared by blending each base formulation with various amounts of softened water, followed by measuring the viscosity of each formulation. The results are set forth below in Table 2—the amounts are set forth in weight percentage (wt. %).

TABLE 2

| | Comp. Ex. 1 | Comp. Ex. 2 | Comp. Ex. 3 | Comp. Ex. 4 | Ex. 1 | Ex. 2 | Ex. 3 | Ex. 4 |
|---|---|---|---|---|---|---|---|---|
| Composition A | 75.0 | 50.0 | 25.0 | 0.0 | — | — | — | — |
| Composition B | — | — | — | — | 75.0 | 50.0 | 25.0 | 0.0 |
| Water | 25.0 | 50.0 | 75.0 | 100.0 | 25.0 | 50.0 | 75.0 | 100.0 |
| Total | 100.0 | 100.0 | 100.0 | 100.0 | 100.0 | 100.0 | 100.0 | 100.0 |
| Viscosity (cps) | 650 | 1600 | 700 | 100 | 650 | 3500 | 6500 | 400 |

As demonstrated by the data described in Table 2 (above), the surfactant blend of the present invention provided a surprising improvement in the ability to adjust viscosity of the resulting cleaning composition as the amount of water was modified compared to cleaning compositions that did not include the polyglyceyl-3 laurate surfactant. Such unexpected discovery provides for a valuable mechanism that allows the viscosity of cleaning compositions to be custom tailor based on the desired final application.

Example 2

A second experiment was performed by taking the blended cleaning formulations of Example 1 (Ex. 1) and Comparative Example 1 (Comp. Ex. 1) and testing the low-temperature stability at temperatures of −4° C. and −10° C. Specifically, each formulation of Ex. 1 and Comp. Ex. 1 were chilled to a temperature of −4° C. and then observed for clumping and/or phase separation of components from water. The same test was repeated at a temperature of −10° C. The results of each evaluation are set forth below in Table 3

TABLE 3

| Composition | Test at −4° C. | Test at −10° C. |
|---|---|---|
| Comp. Ex. 1 | Pass | Pass |
| Ex. 1 | Pass | Pass |

As demonstrated by the data described in Table 3 (above), the addition of the polyglyceryl-3 laurate surfactant surprisingly did not diminish the low-temperature stability of the resulting cleaning composition, as compared to that of cleaning compositions not containing the polyglycerl-3 laurate surfactant.

As a result, the cleaning composition of the present invention not only can exhibit a superior flexibility in adjusting the desired viscosity of the cleaning composition, but such viscosity adjustments can surprisingly be performed without diminishing the low-temperature stability of the resulting cleaning composition.

Example 3

A third experiment was performed to measure the foaming properties of the polyglyceryl-3 laurate surfactant. This experiment included a fourth surfactant ("Surfactant 4") which is a nonionic surfactant comprising isodecyl alcohol ethoxylate. This experiment included a second cleaning salt ("Cleaning Salt 2") comprising sodium chloride. The formulations are set forth below in Table 4—the amounts are set forth in weight percentage (wt. %):

TABLE 4

| Component | Comp. Ex. 5 | Ex. 5 | Ex. 6 | Ex. 7 | Ex. 8 |
|---|---|---|---|---|---|
| Water | 50.9 | 50.4 | 49.9 | 49.4 | 47.4 |
| Surfactant 1 | — | 0.5 | 1.0 | 1.5 | 3.0 |
| Surfactant 2 | 17.57 | 17.57 | 17.57 | 17.57 | 17.57 |
| Surfactant 3 | 26.0 | 26.0 | 26.0 | 26.0 | 26.0 |
| Surfactant 4 | 2.21 | 2.21 | 2.21 | 2.21 | 2.21 |
| Preservative | 0.14 | 0.14 | 0.14 | 0.14 | 0.14 |
| Cleaning Salt 1 | 2.0 | 2.0 | 2.0 | 2.0 | 2.0 |
| Cleaning Salt 2 | 0.5 | 0.5 | 0.5 | 0.5 | 0.5 |
| DTPA | 0.31 | 0.31 | 0.31 | 0.31 | 0.31 |
| Fragrance | 0.37 | 0.37 | 0.37 | 0.37 | 0.37 |
| Total | 100.0 | 100.0 | 100.0 | 100.0 | 100.0 |

Each cleaning formulation was then subjected to a shaker test, whereby 0.1% of the cleaning formulation was added to a water bath and shaken for a several cycles. The evaluations include a flash foam test, which measures the foam volume after 8 cycles. The evaluations include a maximum foam test, which measures the foam volume after 14 cycles. The evaluations include a foam decay test, which measures the rate at which the foam decreases for minutes after shaking has ceased. The results of the evaluations are set forth below in Table 5.

TABLE 5

| Component | Flash Foam (mL) | Max Foam (mL) | Foam Decay (mL/min) |
|---|---|---|---|
| Comp. Ex. 5 | 206 | 375 | 27 |
| Ex. 5 | 217 | 399 | 23 |
| Ex. 6 | 215 | 379 | 15 |
| Ex. 7 | 242 | 400 | 27 |
| Ex. 8 | 248 | 398 | 27 |

As demonstrated by the data described in Table 5 (above), while the addition of the polyglyceryl-3 laurate surfactant slightly increased the amount of flash foam as the amount of polyglercyl-3 laurate increased, however, there was no statistically significant change in the maximum foaming. In the addition to the rate of foam decay at 0.5 wt. % and 1.0 wt. % being lower than that of the Comparative Example 5 composition, this indicates that an amount of polyglycerl-3 laurate ranging from at least about 0.5 wt. % to about 1.0 wt. % is significant as it surprisingly provides the same maximum foam volume while also providing an improved rate of foam decay.

As those skilled in the art will appreciate, numerous changes and modifications may be made to the embodiments described herein without departing from the spirit of the invention. It is intended that all such variations fall within the scope of the appended claims.

What is claimed is:

1. A home care composition comprising:

a surfactant system comprising polyglyceryl-3 laurate, a zwitterionic surfactant, an anionic surfactant, and a nonionic surfactant alcohol ethoxylate; and a carrier;

wherein the polyglyceryl-3 laurate comprises from about 0.5 w % to about 1.5 w % of the home care composition;

wherein the zwitterionic surfactant comprises from about 10 wt. % to about 25 wt. %, of the home care composition; and wherein the anionic surfactant comprises from about 21 wt. % to about 28 wt. %, of the home care composition.

2. The home care composition according to claim 1, wherein the polyglyceryl-3 laurate comprises from about 0.5 wt. % to about 1.0 wt. %, of the home care composition.

3. The home care composition according to claim 1, wherein the zwitterionic surfactant comprises an amine oxide.

4. The home care composition according to claim 3, wherein the amine oxide is selected from: lauryl aminopropyl dimethyl amine oxide; and myristyl aminopropyl dimethyl amine oxide, and a mixture thereof.

5. The home care composition according to claim 1, wherein the anionic surfactant is selected from: an alkyl sulfate; an alkyl ether sulfate; an alkaryl sulfonate; an alkyl succinate; an alkyl sulfosuccinate; a N-alkoyl sarcosinate; an alkyl phosphate; an alkyl ether phosphate; an alkyl ether carboxylate; an alkylamino acid; an alkyl peptide; an alkoyl taurate; a carboxylic acid; an acyl or alkyl glutamate; an alkyl isethionate; an alpha-olefin sulfonate; and a combination of two or more thereof.

6. The home care composition according to claim 5, wherein the anionic surfactant is selected from an alkyl sulfate; an alkyl ether sulfate, and combinations thereof.

7. The home care composition according to claim 6, wherein the alkyl ether sulfate is selected from: an ammonium lauryl ether sulfate; an alkali metal lauryl ether sulfate, and a mixture thereof.

8. The home care composition according to claim 7, wherein the alkyl ether sulfate has an ethoxylation of from about 0.5 to about 2.

9. The home care composition according to claim 8, wherein the alkyl ether sulfate has an ethoxylation of about 0.6.

10. The home care composition according to claim 1, wherein the zwitterionic surfactant comprises from about 14 wt. % to about 19 wt. % of the home care composition.

11. The home care composition according to claim 1, wherein the composition has a viscosity of from about 250 cps to about 7,000 cps.

12. The home care composition according to claim 1, wherein the composition is a liquid dish detergent.

13. The home care composition according to claim 1, wherein the non-ionic surfactant and the zwitterionic surfactant are present in a weight ratio of from about 1:4 to about 1:9.

14. The home care composition according to claim 1, wherein the non-ionic surfactant and the anionic surfactant are present in a weight ratio of from about 1:14 to about 1:33.

15. The home care composition according to claim 1, wherein the zwitterionic surfactant and the anionic surfactant are present in a weight ratio of from about 1:1 to about 1:5.

* * * * *